United States Patent [19]

Reuchlin et al.

[11] Patent Number: 4,470,715

[45] Date of Patent: Sep. 11, 1984

[54] DISPENSER/APPLICATOR FOR NAIL POLISH AND THE LIKE

[76] Inventors: Johan G. Reuchlin, 1, Oude Maasdijk, Dreumel; Willem A. Dekker, 37 Rijsdijk, Rhoon, both of Netherlands

[21] Appl. No.: 276,354

[22] PCT Filed: Oct. 24, 1980

[86] PCT No.: PCT/NL80/00035

§ 371 Date: Jun. 19, 1981

§ 102(e) Date: Jun. 19, 1981

[87] PCT Pub. No.: WO81/01129

PCT Pub. Date: Apr. 30, 1981

[30] Foreign Application Priority Data

Oct. 26, 1979 [NL] Netherlands ..... 7907879

[51] Int. Cl.[3] ..... A46B 11/00

[52] U.S. Cl. ..... 401/115; 401/101; 401/272; 401/274

[58] Field of Search ..... 401/101, 115, 156, 157, 401/169, 155, 132–135, 272, 274, 278

[56] References Cited

U.S. PATENT DOCUMENTS

| | | | |
|---|---|---|---|
| 591,908 | 10/1897 | Argall . | |
| 745,503 | 12/1903 | Langill . | |
| 818,666 | 4/1906 | Caddell et al. | 401/274 |
| 1,949,327 | 2/1934 | Picard . | |
| 1,960,387 | 5/1934 | Marcher . | |
| 2,485,494 | 10/1949 | Jockers . | |
| 2,506,035 | 5/1950 | Parker | 401/156 X |
| 2,525,272 | 10/1950 | Rhoton . | |
| 2,908,926 | 10/1959 | Jockers . | |
| 2,932,046 | 4/1960 | Skolnikoff | 401/115 |
| 2,944,274 | 7/1960 | Hopkins . | |
| 3,144,676 | 8/1964 | La Mura | 401/115 |
| 3,157,314 | 11/1964 | Nadler . | |
| 3,159,863 | 12/1964 | La Mura | 401/115 |
| 3,223,289 | 12/1965 | Bouet | 401/157 X |
| 3,737,242 | 6/1973 | Hesebeck et al. | 401/157 |
| 3,877,822 | 4/1975 | La Mura . | |
| 3,938,706 | 2/1976 | Cohen . | |
| 4,063,829 | 12/1977 | Mura | 401/115 X |

FOREIGN PATENT DOCUMENTS

| | | | |
|---|---|---|---|
| 1586740 | 6/1967 | Fed. Rep. of Germany . | |
| 2425062 | 12/1975 | Fed. Rep. of Germany | 401/115 |
| 2720907 | 11/1977 | Fed. Rep. of Germany . | |
| 1031878 | 3/1953 | France . | |
| 1039827 | 10/1953 | France . | |
| 1087410 | 8/1955 | France . | |
| 1314002 | 11/1961 | France . | |
| 2159543 | 6/1973 | France . | |
| 308254 | 5/1933 | Italy | 401/278 |
| 412407 | 12/1945 | Italy | 401/157 |
| 92432 | 12/1955 | Netherlands . | |
| 88852 | 1/1957 | Norway | 401/115 |
| 650680 | 2/1951 | United Kingdom . | |

*Primary Examiner*—Steven A. Bratlie
*Attorney, Agent, or Firm*—Diller, Ramik & Wight

[57] ABSTRACT

An applicator comprising a bush mounted on a stem movable between operating and closed positions. The stem cooperates with a movable ball valve.

18 Claims, 7 Drawing Figures

DISPENSER/APPLICATOR FOR NAIL POLISH AND THE LIKE

Figure 1:
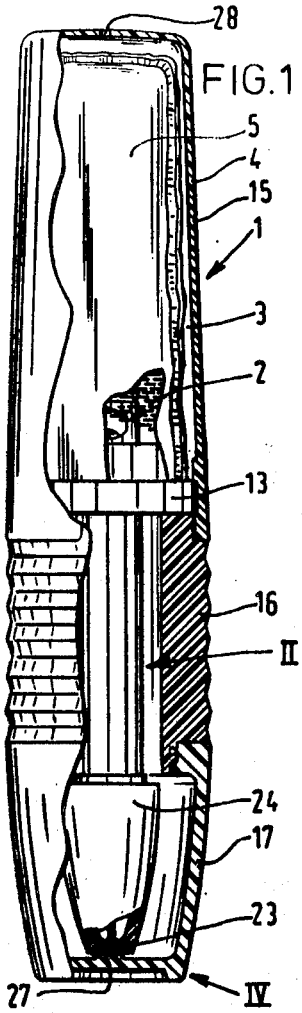

The invention relates to a liquid applicator, comprising a liquid reservoir accommodated in an inner space of a strong envelope and a liquid outlet provided with dosing means.

Such an applicator is known from German Patent Application No. 2,425,062 laid up for public inspection for dispensing polish, particularly nail polish. The dosing means may be of various types and may comprise a spreading member of rubber or a pencil. An applicator of the kind set forth is furthermore known as a fountain-pen holder. Particularly in those cases in which the amount of liquid to be dosed is small and rapidly hardens and/or dries up, it is quite troublesome when the liquid emerges in an excessive amount and/or at inconvenient instants and/or dries up in the liquid outlet or hardens in any other way. The problem of correct dosing is particularly serious in those cases in which the applicator is disposable and the dosing means must have a low cost.

The invention solves the above mentioned problems in that the liquid reservoir is formed by a bag and in that the same pressure prevails in the inner space of the envelope as on the outer side of the liquid outlet. The invention is based on the recognition of the fact that the emergence of the liquid at an inconvenient instant and/or beyond the desired extent is frequently due to a pressure difference between the pressure prevailing in the reservoir and that outside thereof, which disturbs the operation of the dosing means. The steps taken in accordance with the invention ensure that the liquid in the reservoir is subjected to atmospheric pressure.

The invention is particularly important when the dosing means comprise a spreading member which is movable between a rest position, in which it is drawn into the liquid outlet and a working position, in which it is exposed out of the liquid outlet. The fluid, for example, glue or polish, must not harden or dry up in the said rest position so that the spreading member remains satisfactorily usable.

The invention will be described more fully hereinafter with reference to a drawing by way of example.

Figure 2:
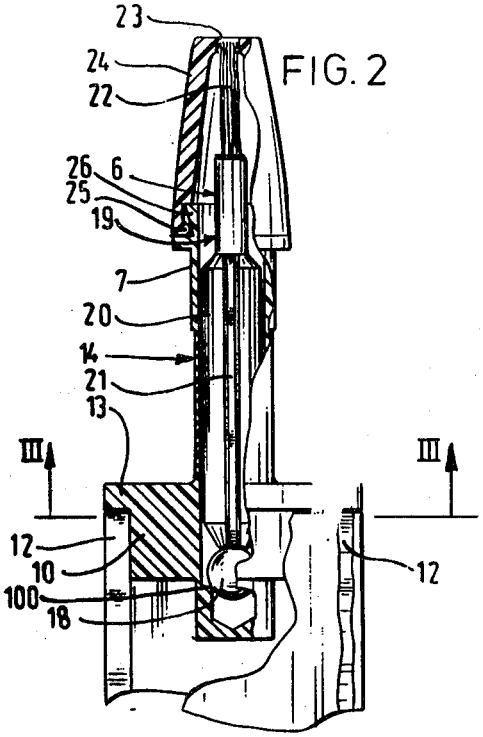
Figure 3:
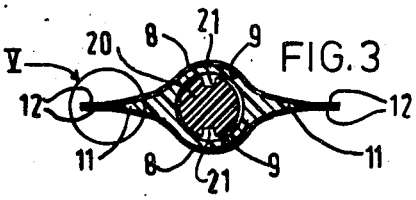
Figure 5:
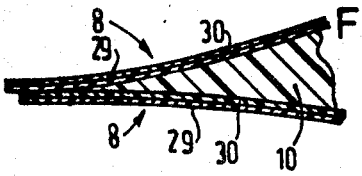
Figure 4:
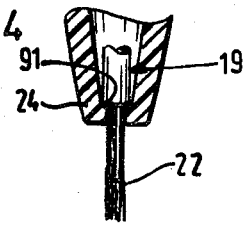
Figure 6:
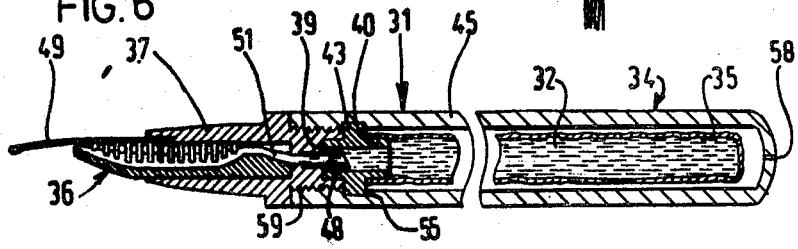
Figure 7:
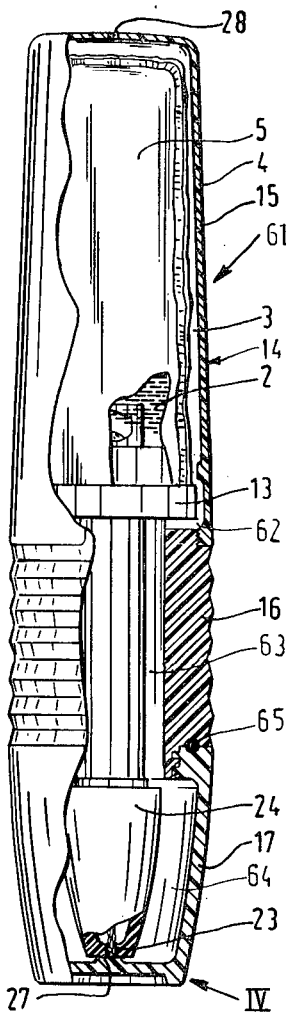

The drawing shows in:

FIGS. 1 and 7 each illustrate a side elevation partly broken away of a different embodiment of a polish applicator in accordance with the invention, FIG. 2 is a side elevation partly broken away of detail II of FIG. 1, FIG. 3 is a sectional view taken on the line III—III in FIG. 2, FIG. 4 is a detail IV of the polish applicator of FIG. 1 in its working position, FIG. 5 is an enlarged scale detail V of FIG. 3, and FIG. 6 is a sectional view of a fountain-pen holder in accordance with the invention.

The dispenser/applicator 1 of FIG. 1, particularly intended for dispensing doses of polish, 2, particularly nail polish comprises a liquid reservoir arranged in an inner space 3 of an envelope or body 4 and a liquid outlet 7 provided with dosing means 6.

According to the invention the liquid reservoir is formed by a soft bag 5. It has two flanks 8, which are preferably thermally welded to outer sides 9 of a shoulder piece 10 connected with the liquid outlet 7 and having an eye-shaped cross-section (FIG. 3), the two outer sides 9 of which enclose two acute eye-corners 11. Preferably, these outer sides 9 extend substantially towards the interconnected parts 12 of the bag flanks 8 extending beyond the shoulder piece 10. The shoulder piece 10 together with an appreciable portion of the liquid outlet 7 and a collar 13 which is an integral portion of the nozzle made in the form of a single spray-casting of synthetic resin, preferably polyacrylonitril, which can satisfactorily adhere by hot-welding to the inner sides of the bag flanks 8 of the same synthetic resin.

The body 4 may be formed by a shell 15, a neck 16 screwed thereon with the interposition of the collar 13 and a locking cap 17 screwed to the latter.

The dosing means 6 arranged in the tubular liquid outlet 7 extending through the collar 13 and the shoulder piece 10 comprise a steel ball 18 and a pencil 19. The pencil 19 has a metal stem 20 in which axial liquid channels 21 are provided and pencil hairs 22 extending in a central orifice 23 of an outlet cap 24 of the liquid outlet 7. In the case of a round stem such liquid chanels can be made in the inner bore of the spray-casting 14. The outlet cap 24 of elastic synthetic resin forms part of the nozzles and engages by a snap-rim 25 a collar 26 of the nozzle portion 14.

In the stored state an inwardly directed protuberance 27 hermetically closes the preferably circular orifice 23.

When the closing cap 17 is removed, the dosing means 6 are axially movable downwards in the liquid outlet 7 and thus the spreading member formed by a circular bunch of pencil hairs 22 moves from the rest position indicated by solid lines in FIG. 1 into a position of exposure out of the liquid outlet 7 as shown in FIG. 4, in which case the rim 91 of the pencil 19 is in sealing relationship with the elastic closing cap 17 of synthetic resin. In the rest position the bunch of pencil hairs 22 closes the orifice 23 substantially completely. Moreover, the ball 18 is in sealing relationship with its seat 100 so that the entire outlet 7 remains filled with polish 2 and the pencil hairs 22 remain dipped in the polish 2. When the recipient is turned into the position shown in FIG. 2, the pencil 19 operates, so as to say, like a pump dispensing an amount of polish equal to the previously emerging volume of the pencil hairs 22. That is to say, the ball 18 seats before the stem 20 of the applicator has sunk to the position shown in FIG. 2 so that as the stem sinks to such final or fully retracted position, the liquid trapped in the passage above the ball 18 is displaced upwardly within the passage and in the reservoir chamber defined by the nozzle tip portion 24 so that, as aforesaid, the bristles 22 remain immersed in the polish. Since the inner space 3 communicates through an orifice 28 with the atmosphere, the polish 2 is not pressed outwards by a pressure difference out of the bag 5 through the liquid outlet 7. Neither is air sucked in, which might give rise to hardening or drying of the polish 2.

As is shown in FIG. 5, the bag flanks 8 may consist each of a lamina of two foils 29 and 30, for example, of a foil 30 directed to the shoulder piece 10 and made from material satisfactorily adhering to the material of the shoulder piece 10. The foil 30, like the shoulder piece 10 may consist of polyacrylonitril, which is satisfactorily resistant to acetone of nail polish, whereas the outer foil 29 may consist of polyester, which is less expensive, but strong. A bag formed by such a lamina is strong and yet supple and is capable of reliably storing lacquer for nail polish for a long time. Because the foils 29 and 30 are transparent. the quantity remaining in the reservoir 5 can be constantly checked.

The dispenser/applicator 1 according to the invention is particularly suitable for holding nail polish, other lacquers and glue and particularly in situations in which the device is held in the hand or warmed in a different way and/or is carried in an aeroplane in a pocket or handbag.

The application of the present invention is furthermore interesting for a fountainpen holder 31 as shown in FIG. 6, in which ink 32 is contained in a soft bag 35 hot-welded to a shoulder piece 40. The bag 35 filled with ink 32 with the shoulder piece 40 constitutes a closed, exchangeable disposable packing. The shoulder piece 40 has a collar 43 and a front wall 39 to be perforated. The fountain-pen holder 31 comprises an envelope 34 having an orifice 58 and an ink out let 37 provided with dosing means 36. The dosing means 36 are formed by the pen 49 of known kind and a capillary channel 51, the end of which (48) perforates by its sharp tip the wall 39 of an inserted, new filling, when the collar 43 thereof is clamped between the shoulder 55 and the outlet 37 by screwing the envelope 45 onto the outlet 37. The orifice 58 may, if desired, be replaced by an ample screwthread joint 59 allowing air to pass from the inner space of the envelope 45 to the atmosphere and conversely.

It should be noted that the term "strong envelope" is to be understood as a rigid, for example, sheet-iron body but also a strong envelope of a synthetic resin, which can be deformed, for example, by pinching it. It is then incidentally possible to shut the hole in the strong synthetic resin envelope by a finger and to pinch the envelope by hand in order to raise the pressure in the interior of the envelope, which higher pressure contributes to the expulsion of an additional quantity through the outlet.

The dispenser/applicator 61 of FIG. 7 only differs from the dispenser/applicator 1 in that the orifice 28 is replaced by an air passage 62 through the collar 13 for establishing a communication between the inner space 3 via the space 63 between the spray-casting 14 and the neck 16 and the atmosphere or, if the closing cap 17 is present, the inner space 64 thereof. In the case of a closing cap 17 with, for example, a sealing ring 65, the same pressure will prevail on the outer side of the orifice 23 as in the inner space 3 as long as the closing cap 17 is in its sealing position, so that leakage through the orifice 23 is avoided. Moreover, when the bag 5 is accidentally perforated, the liquid cannot emerge further than the cap 17.

We claim:

1. A dispenser/applicator device for liquids such as nail polish and the like, comprising a hollow body defining an interior space, a liquid supply within said interior space and containing a supply of the liquid to be dispensed, an elongate applicator nozzle carried by said body and having one end thereof communicating with the interior of said liquid supply, said nozzle having an elongate passage provided with a constriction near said one end to define a valve seat, a valve member freely movable within said passage and adapted to seat by gravity on said valve seat when the device is in upright position to block back flow communication between said passage and the interior of said liquid supply, an applicator separate from said valve member having a stem slidable within said passage beyond said valve member and surmounted by an axially projecting liquid-absorbing applicator, said nozzle including a nozzle tip portion at the other end thereof defining a reservoir chamber which receives liquid from said passage, said nozzle tip portion having an end aperture adapted to permit free passage of said liquid-absorbing applicator between a retracted position within said reservoir chamber when the device is upright and a projected position when the device is inverted, the length of said stem and said liquid-absorbing applicator being such that the tip of said liquid-absorbing applicator is disposed within the confines of said end aperture when the device is upright and said stem rests upon the seated valve member, said stem having a valving portion adjacent said liquid-absorbing applicator engageable with said nozzle tip portion at said end aperture when the liquid-absorbing applicator is fully projected to block flow of liquid through said end aperture, said liquid-absorbing applicator having a cross section substantially completely filling said end aperture to effectively block said end aperture against the free leakage of liquid from said reservoir chamber and to cause the liquid-absorbing applicator to be doctored by the nozzle tip portion around the end aperture while the applicator is moving toward projected position when the device is inverted so that the liquid-absorbing applicator is not excessively loaded during projection thereof, said liquid supply being in the form of a flaccid bag and said body having a vent communicating said interior space to ambient atmosphere whereby said valve member seats to block communication between said liquid supply and said reservoir chamber prior to excessive back flow of liquid to said bag when the device is returned to upright position so that said stem and liquid-absorbing applicator while sinking to the retracted position displace liquid upwardly within said passage and said reservoir chamber to maintain the level of liquid therein such that said liquid-absorbing applicator is substantially fully immersed in liquid and air is substantially excluded from the reservoir chamber when the applicator is fully retracted.

2. A dispenser/applicator device according to claim 1 wherein said liquid-absorbing applicator comprises a bundle of bristles.

3. A dispenser/applicator device as defined in claim 2 wherein said valve member is a metal ball and said stem is made of metal.

4. A dispenser/applicator device for liquids such as nail polish and the like, comprising a hollow body defining an interior space, a liquid supply within said interior space and containing a supply of the liquid to be dispensed, an elongate applicator nozzle carried by said body and having one end thereof communicating with the interior of said liquid supply, said nozzle having an elongate passage provided with a constriction near said one end to define a valve seat, a valve member movable within said passage and adapted to seat by gravity on said valve seat when the device is in upright position to block back flow communication between said passage and the interior of said liquid supply, an applicator separate from said valve member having a stem slidable within said passage and surmounted by an axially projecting liquid-absorbing applicator, said nozzle including a nozzle tip portion at the other end thereof defining a reservoir chamber which receives liquid from said passage, said nozzle tip portion having an end aperture adapted to permit free passage of said liquid-absorbing applicator whereby said applicator is movable between a fully retracted position when the device is upright and a fully projected position when the device is inverted, the length of said stem and said liquid-absorbing applicator being such that the tip of said liquid-absorbing applicator is disposed within the confines of said end aperture when the device is upright and said applicator is in said retracted position, said stem having a valving portion adjacent said liquid-absorbing applicator engageable with said nozzle tip portion at said end aperture to block flow of liquid through said end aperture when the applicator is in said fully projected position, said liquid-absorbing applicator having a cross section substantially completely filling said end aperture to effectively block said end aperture against the free leakage of liquid from said reservoir chamber and to cause the liquid-absorbing applicator to be doctored by the nozzle tip portion around the end aperture while the applicator is moving toward said fully projected position when the device is inverted so that the liquid-absorbing applicator is not excessively loaded during projection thereof, said fluid supply being in the form of a flaccid bag and said body having a vent communicating said interior space to ambient atmosphere whereby said valve member seats to block communication between said liquid supply and said reservoir chamber prior to excessive back flow of liquid to said bag when the device is returned to upright position so that said stem and liquid-absorbing applicator while sinking to the fully retracted position displace liquid upwardly within said passage and said reservoir chamber to maintain the level of liquid therein such that said liquid-absorbing applicator is immersed in liquid within the reservoir chamber when the applicator is in said fully retracted position.

5. A dispenser/applicator device as defined in claim 4 wherein said nozzle includes a shoulder portion having an eye-shaped cross section and said bag includes a mouth attached to and filled by said shoulder portion.

6. A dispenser/applicator device as defined in claim 5 wherein said bag comprises superposed layers of synthetic resinous material which are sealed together along their sides and bottoms.

7. A dispenser/applicator device as defined in claim 6 wherein each layer is of double thickness comprising an inner foil of polyacrylonitrile and an outer foil of polyester.

8. A dispenser/applicator device as defined in claim 4 wherein said stem is made of metal and is provided with a longitudinally extending liquid by-pass channel.

9. A dispenser/applicator device as defined in claim 4 wherein said valve member is a metal ball.

10. A dispenser/applicator device as defined in claim 4 wherein said valve member is a metal ball.

11. A dispenser/applicator device according to claim 4 wherein said liquid-absorbing applicator comprises a bundle of bristles.

12. A dispenser/applicator device for liquids such as nail polish and the like, comprising a hollow body, a dispenser/applicator carried within said body and presenting a hollow nozzle tip portion at one end thereof, said hollow nozzle tip portion having an end aperture, and a removable closure cap at said one end of the body which seals off said end aperture, said dispenser/applicator device including a flaccid bag disposed within the other end of said hollow body and a nozzle communicating with said bag and projecting therefrom toward said one end of the body, said nozzle presenting a passage and being surmounted by said hollow nozzle tip portion, check valve means within said passage near said bag for blocking communication between said passage and said bag to trap liquid within said passage and hollow nozzle tip portion when the device is returned from an inverted to an upright position and said hollow body being vented to ambient atmosphere whereby liquid may flow by gravity from said bag into said passage and said hollow nozzle tip portion when the device is inverted whereas only a limited amount of such liquid may flow back by gravity into the bag prior to closing of said check valve means when the device is returned to upright position, said dispenser/applicator also including a weighted stem slidable in said passage and surmounted by a liquid-absorbing applicator projecting axially therefrom, said stem and said liquid-absorbing applicator being of a length such that when the device is in upright position the distal end of said liquid-absorbing applicator is at said end aperture and said liquid-absorbing applicator having a cross section which substantially fills but is freely slidable through said end aperture whereby to effect a limited valving action thereat in any position of the device, said stem having a portion adjacent said liquid-absorbing applicator which is engageable with said nozzle tip portion to close off said end aperture when said cap is removed and said stem has dropped to project said liquid-absorbing applicator through said end aperture.

13. A dispenser/applicator device as defined in claim 12 wherein said nozzle includes a shoulder portion having an eye-shaped cross section and said bag includes a mouth attached to and filled by said shoulder portion.

14. A dispenser/applicator device as defined in claim 13 wherein said bag comprises superposed layers of synthetic resinous material which are sealed together along their sides and bottoms.

15. A dispenser/applicator device as defined in claim 14 wherein each layer is of double thickness comprising an inner foil of polyacrylonitrile and an outer foil of polyester.

16. A dispenser/applicator device as defined in claim 12 wherein said stem is made of metal and is provided with a longitudinally extending liquid by-pass channel.

17. A dispenser/applicator device as defined in claim 19 wherein said check valve means is a metal ball.

18. A dispenser/applicator device according to claim 12 wherein said liquid-absorbing applicator comprises a bundle of bristles.

* * * * *